US008777326B2

(12) United States Patent
Hall

(10) Patent No.: US 8,777,326 B2
(45) Date of Patent: Jul. 15, 2014

(54) PICK WITH HARDENED CORE ASSEMBLY

(76) Inventor: David R. Hall, Provo, UT (US)

( * ) Notice: Subject to any disclaimer, the term of this patent is extended or adjusted under 35 U.S.C. 154(b) by 222 days.

(21) Appl. No.: 13/355,732

(22) Filed: Jan. 23, 2012

(65) Prior Publication Data

US 2013/0187438 A1 Jul. 25, 2013

(51) Int. Cl.
*E21C 35/19* (2006.01)

(52) U.S. Cl.
USPC ..... 299/104; 299/113

(58) Field of Classification Search
USPC ..... 299/104, 113
See application file for complete search history.

(56) References Cited

U.S. PATENT DOCUMENTS

| | | | | |
|---|---|---|---|---|
| 3,342,532 | A | 9/1967 | Krekeler | |
| 3,807,804 | A | 4/1974 | Kniff | |
| 4,804,231 | A * | 2/1989 | Buljan et al. | 299/113 |
| 5,417,475 | A | 5/1995 | Graham | |
| 6,099,081 | A * | 8/2000 | Warren et al. | 299/104 |
| 6,102,486 | A * | 8/2000 | Briese | 299/111 |
| 7,390,066 | B2 * | 6/2008 | Hall et al. | 299/81.1 |
| 7,396,086 | B1 | 7/2008 | Hall | |
| 7,600,823 | B2 * | 10/2009 | Hall et al. | 299/106 |
| 7,648,210 | B2 * | 1/2010 | Hall et al. | 299/104 |
| 8,091,655 | B2 | 1/2012 | Shen et al. | |
| 2009/0256413 | A1 * | 10/2009 | Majagi et al. | 299/100 |

FOREIGN PATENT DOCUMENTS

| | | |
|---|---|---|
| DE | 3818213 | 11/1989 |
| GB | 2004315 | 3/1979 |

* cited by examiner

*Primary Examiner* — John Kreck
(74) *Attorney, Agent, or Firm* — Philip W. Townsend, III

(57) ABSTRACT

A pick assembly comprising a pick body comprising a shank opposite a front end. The shank may be configured for attachment to a driving mechanism while the front end may comprise a core assembly disposed within an axial bore of the front end. The core assembly may comprise a cutting element bonded to a substrate attached to a bolster disposed within a sleeve which is disposed within the axial bore.

11 Claims, 11 Drawing Sheets

PICK WITH HARDENED CORE ASSEMBLY

BACKGROUND OF THE INVENTION

The present invention relates generally to pick assemblies used in the degradation of formations. The working life span of pick assemblies used for degradation applications is typically very limited, especially when engaging harder formations. As pick assemblies begin to wear their performance capabilities also begin to diminish. Consequently, many efforts have been made to extend the working life span of pick assemblies some of which are included in the following prior art references.

U.S. Pat. No. 5,417,475 to Graham et al., which is herein incorporated by reference for all that it contains, discloses a breaking or excavating tool that has a diamond and/or cubic boron nitride coated cutting insert mounted at the forward end of a tool body which is made of a softer material than the insert. A separately formed retaining member such as a washer, ring, or sleeve, made of harder material than the body, is brazed to a front face of the body surrounding the insert to protect the tool body against wear.

U.S. Pat. No. 3,807,804 to Kniff, which is herein incorporated by reference for all that it contains, discloses an impacting tool in which a massive hard carbide element is fitted to a steel holder which is reciprocated to drive the element against a formation to be broken. The massive carbide element can be press fitted in the steel holder or shrink fitted therein or brazed thereto and, furthermore, the carbide element can be fitted to a steel sleeve adapted for being secured to a steel holder as by threading or brazing.

U.S. Pat. No. 7,401,863 to Hall et al., which is herein incorporated by reference for all that it contains, discloses a pick that comprises a shank attached to a base of a steel body, a cemented metal carbide core press fit into the steel body opposite the shank, and an impact tip bonded to a first end of the core opposite the shank. The impact tip comprises a superhard material opposite the core, and the core comprises a second end and a largest diameter. A distance through the body from the shank to the second end of the core is less than the largest diameter of the core.

BRIEF SUMMARY OF THE INVENTION

The primary objective of the present invention is to substantially extend the working life span of a pick assembly. To accomplish this objective, one embodiment of a pick assembly of the present invention may comprise a pick body comprising a shank opposite a front end. The shank may be configured for attachment to a driving mechanism while the front end may comprise a core assembly disposed within an axial bore of the front end. The core assembly may comprise a cutting element bonded to a substrate attached to a bolster disposed within a sleeve which is disposed within the axial bore.

To aid in distributing the loads, the material forming the substrate may be substantially stronger than the material forming the bolster. The material forming the bolster may be substantially stronger than the material forming the sleeve. The material forming the bolster and the material forming the sleeve may also be substantially stronger than the material forming the pick body.

The sleeve may comprise a plurality of segments. The sleeve may be shrink fitted around at least a portion of the substrate and the bolster. The sleeve may hold at least a portion of the core assembly under compression. The sleeve may be configured to form a press fit within the axial bore of the front end. The sleeve may comprise axial ribs disposed on an outer surface of the sleeve that are in contact with the axial bore. The sleeve may comprise an annular flange overlapping a portion of the front end wherein a fillet may be disposed between the sleeve and the annular flange.

The cutting element may comprise a conical geometry. The cutting element may comprise a superhard material selected from the group consisting of natural diamond, synthetic diamond, polycrystalline diamond, monocrystalline diamond, cubic boron nitride, tungsten carbide and composites thereof. The cutting element may be bonded to the substrate by a high pressure high temperature process. The cutting element may be bonded to the substrate at an interface comprising a non-planar surface.

The shank may be able to attach to a driving mechanism by means of a compliant clamp, a press fit, a thread, a pin, or combination thereof. The substrate may be attached to the bolster by a brazed joint. A portion of the bolster may be configured to form a press fit with the axial bore of the front end. The substrate and bolster may comprise substantially equal diameters.

It is believed that the aforementioned composition and configuration of the core assembly will exhibit greater durability than the pick body and enable the pick assembly to achieve an extended working life span despite any wear that may occur on the pick body itself.

DETAILED DESCRIPTION OF THE INVENTION AND THE PREFERRED EMBODIMENT

Figure 1:
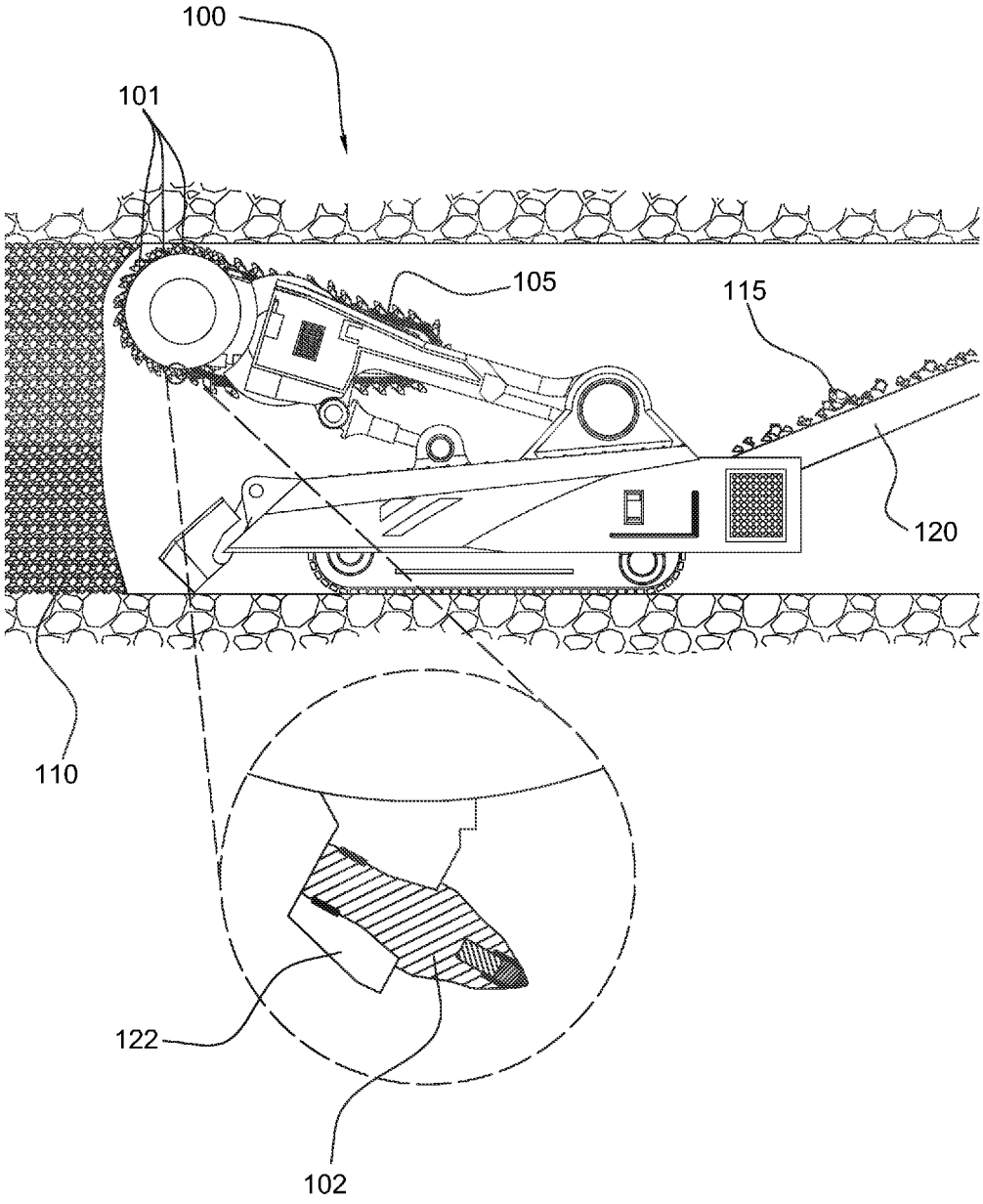
FIG. 1 discloses a side view of an embodiment of a mining machine.

Referring now to the figures, FIG. 1 discloses a side view of an embodiment of a mining machine 100 of a type commonly referred to as a continuous miner. The mining machine 100 may comprise a chain 105 or a large rotating drum (not shown) populated with a plurality of degradation elements 101 that may engage and degrade a natural formation 110 such as coal, iron, base metal ores, stone, talc, soda ash or potash found within an underground mine. The degradation elements 101 may reduce the natural formation 110 to aggregate 115 which may be removed via a conveyor belt 120. Each degradation element 101 may comprise a pick assembly 102

(shown in the magnified view) disposed with a bore of a block 122 which is attached to the chain 105 or rotating drum.

Figure 2:
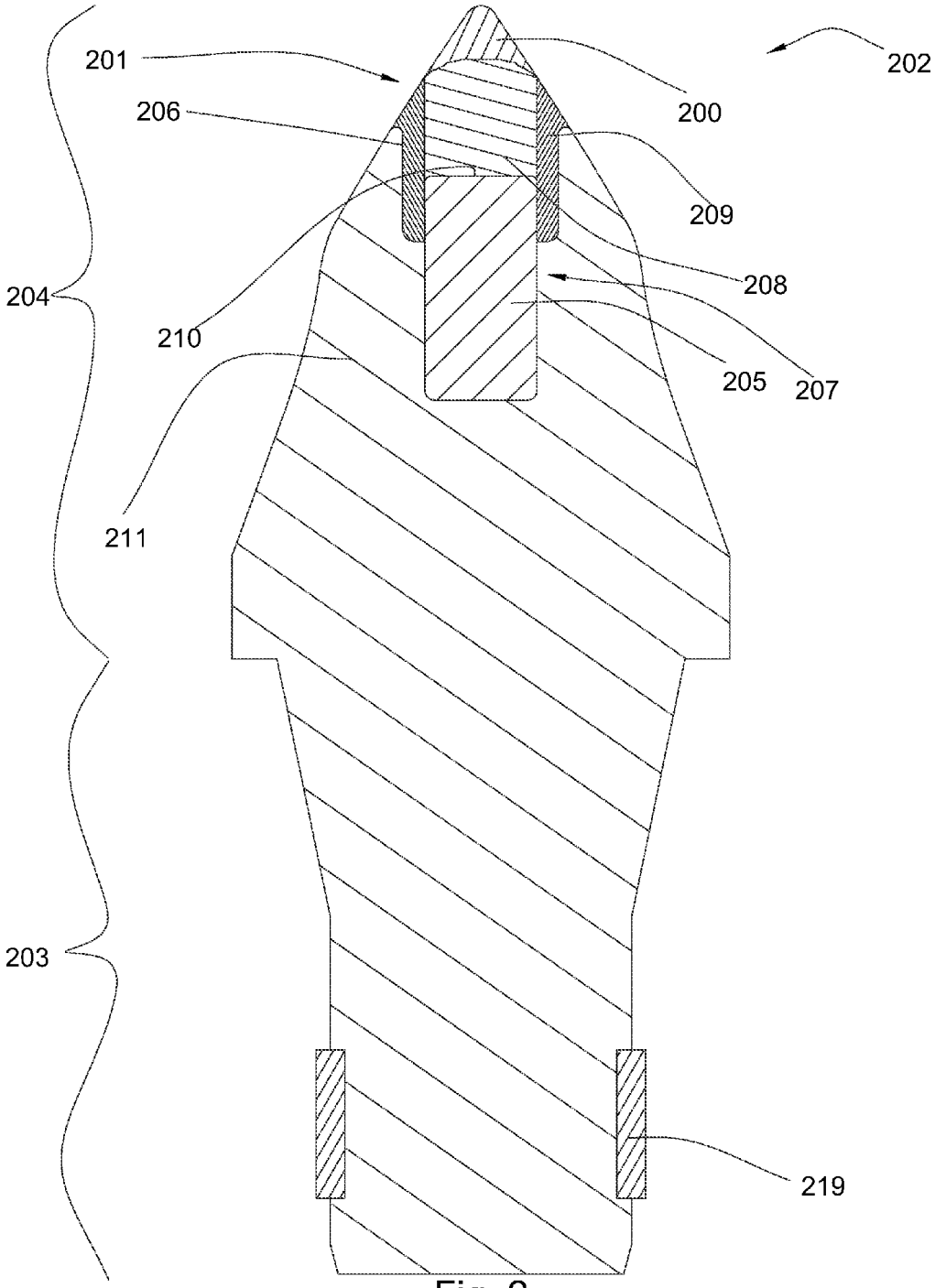
FIG. 2 discloses a cross-sectional view of an embodiment of a pick assembly.

FIG. 2 discloses a cross-sectional view of an embodiment of a pick assembly 202. The pick assembly 202 may comprise a pick body 211 further comprising a shank 203 configured to provide a means of attachment to a block which may be attached to a driving mechanism such as a chain or drum. The means of attachment may comprise a compliant clamp, a press fit, a threaded connection, a pin or combinations thereof. In the embodiment shown, the means for attaching the shank 203 to a driving mechanism comprises a compliant clamp 219 disposed around a lower portion of the shank 203. The pick assembly 202 may further comprise a front end 204 opposite the shank 203 wherein the front end 204 may comprise a core assembly 207 disposed within an axial bore 206 of the front end 204.

The core assembly 207 may comprise a cutting element 200 bonded to a substrate 208 attached to a bolster 205 wherein the substrate 208 may be attached to the bolster 205 by a brazed joint forming an intersection 210. The bolster 205 may be disposed between the substrate 208 and the shank 203 and may support the substrate 208. During degradation operations the substrate 208 in combination with the bolster 205 may assist in distributing stress loads throughout the core assembly 207 and subsequently the pick body 211 which may in turn serve to increase the overall working life span of the pick assembly 202.

The bolster 205 may further prevent undesired or unnecessary movement of the substrate 208 within the axial bore 206 of the front end 204. The added support and reduction of movement of the substrate 208 may assist to prolong the overall integrity of the substrate 208 which may subsequently aid in increasing the overall working life span of the pick assembly 202. In some embodiments, the bolster 205 may be press fit within the axial bore 206 of the pick body 211. The core assembly 207 may also comprise a sleeve 209 disposed within the axial bore 206 of the front end 204 while also surrounding at least a portion of the substrate 208 and the bolster 205. The sleeve 209 may serve to increase the strength of the brazed joint while also helping to hold the substrate 208 and bolster 205 in place. The sleeve 209 may also serve to mitigate damage to the core assembly 207 and cutting element 200 during degradation operations. The sleeve 209 may comprise a material that possesses greater strength properties than the pick body 211 wherein the pick body 211 may experience significant wear without detrimentally weakening the remaining structural integrity of the pick assembly 202. In some embodiments the hard material may comprise tungsten carbide. In yet other embodiments the sleeve 209 may continue to provide support to and for the pick assembly 202 well after the pick body 211 has worn away.

The cutting element 200 may form a conical geometry and may be bonded to the substrate 208 by a high pressure high temperature process. The bond may be formed at an interface comprising a non-planar surface. In alternative embodiments the cutting element 200 may be further secured by a portion of the sleeve 209 wherein said sleeve may form a press fit around at least a portion of the cutting element 200. The cutting element 200 may comprise a superhard material selected from the group consisting of natural diamond, synthetic diamond, polycrystalline diamond, monocrystalline diamond, cubic boron nitride, tungsten carbide and composites thereof. Polycrystalline diamond may provide a hardness that is sufficiently able to withstand inflicted stress loads. The cutting element 200 may be supported by both the substrate 208 and bolster 205 of the core assembly 207. The cutting element 200 may be disposed within the front end 204 of the pick assembly 202 and may engage and degrade a formation by applying damaging forces to the formation. The cutting element 200 may engage both natural and manmade formations.

Figure 3:
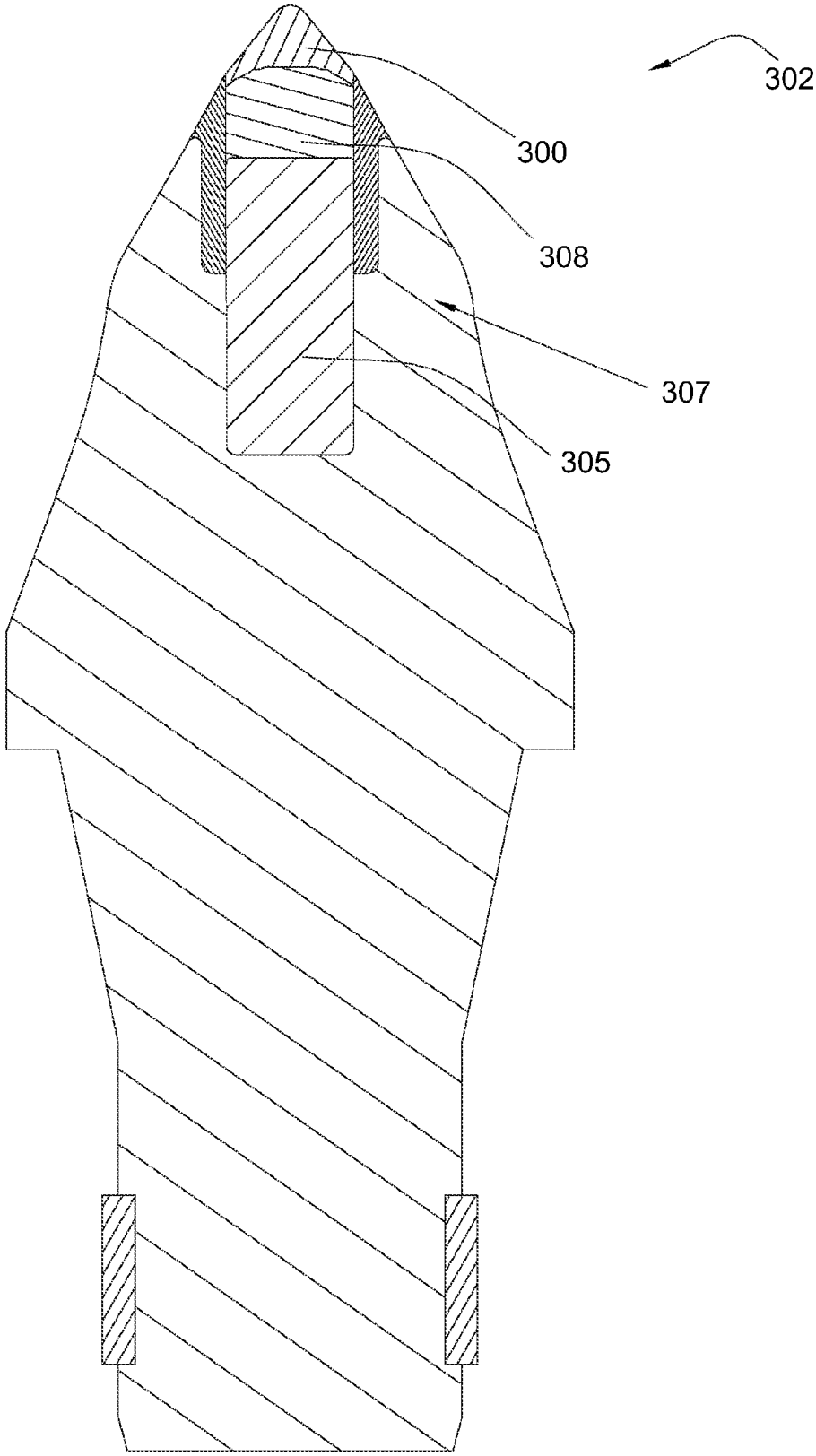
FIG. 3 discloses a cross-sectional view of an alternative embodiment of a pick assembly.

FIG. 3 discloses an alternative embodiment of a pick assembly 302 comprising a core assembly 307 wherein a substrate 308 may be substantially shorter than a bolster 305 while said substrate 308 and bolster 305 also comprise substantially equal diameters. The substrate 308 and bolster 305 may comprise different materials wherein the substrate 308 may comprise a material that is substantially stronger than the material of the bolster 305. The strength of the substrate 308 may be greater than that of the bolster 305 to withstand greater stress loads that may be inflicted upon the substrate 308. While the substantially stronger substrate material may be more expensive than the bolster material, the cost of the substrate 308 may be contained by providing a shorter substrate 308 than the bolster 305.

Figure 4:
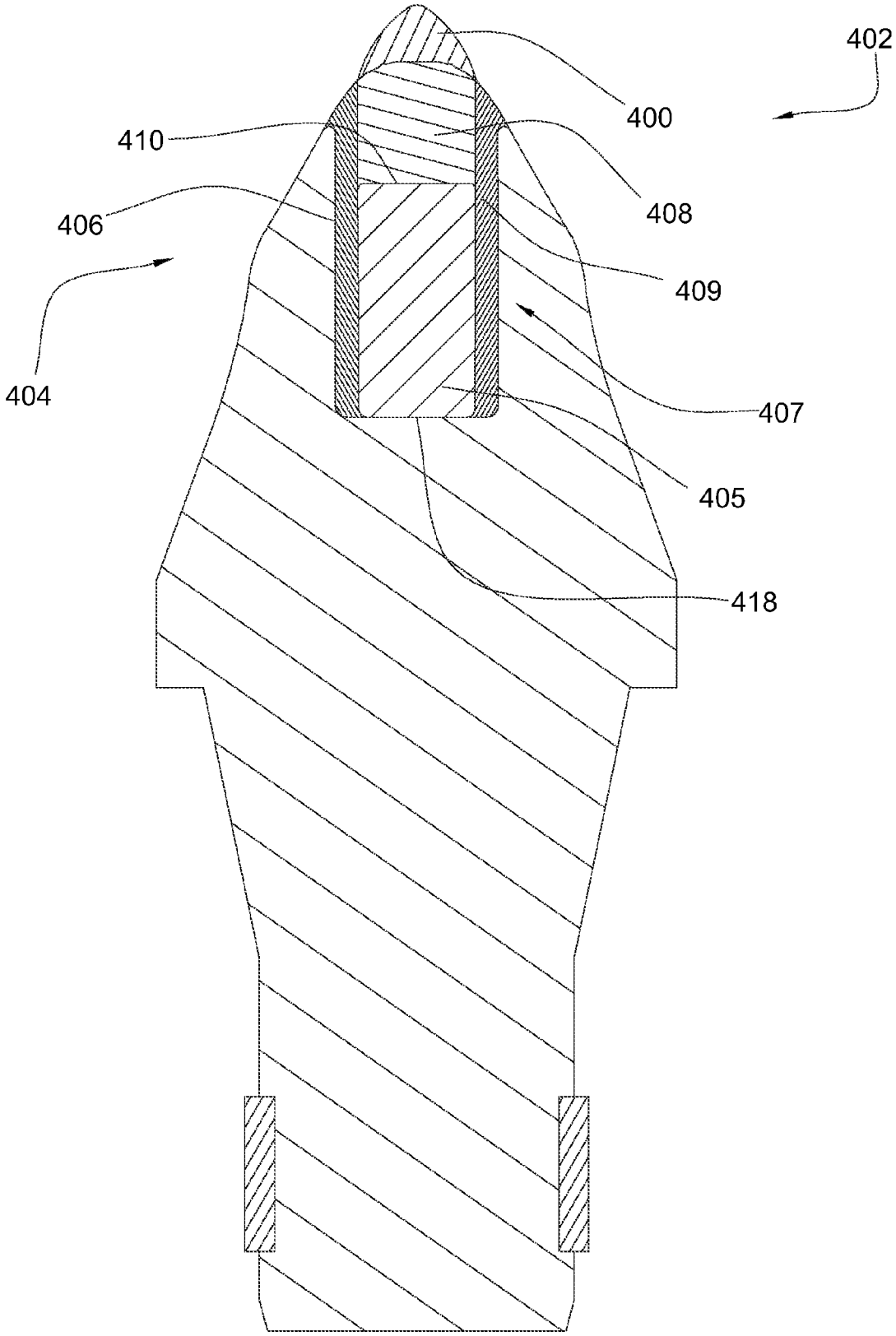
FIG. 4 discloses a cross-sectional view of an alternative embodiment of a pick assembly.

FIG. 4 discloses an alternative embodiment of a pick assembly 402 wherein a sleeve 409 may extend past an intersection 410 disposed between a bolster 405 and a substrate 408 to a distal end 418 of the bolster 405. Lengthening of the sleeve 409 may add additional strength to the pick assembly 402. The additional strength may better support a cutting element 400 of the pick assembly 402 and increase the working life span of the cutting element 400 and subsequently the pick assembly 402. The lengthening of the sleeve 409 may further provide greater support to the substrate 408 and bolster 405 and reduce wear from occurring throughout the pick assembly 402. In some embodiments the sleeve 409 may also hold at least a portion of the core assembly 407 under compression wherein the sleeve 409 may form a press fit within an axial bore 406 of a front end 404 which may help to reduce movement of said core assembly 407 within the axial bore 406 and help to mitigate wear of the core assembly 407.

Figure 5:
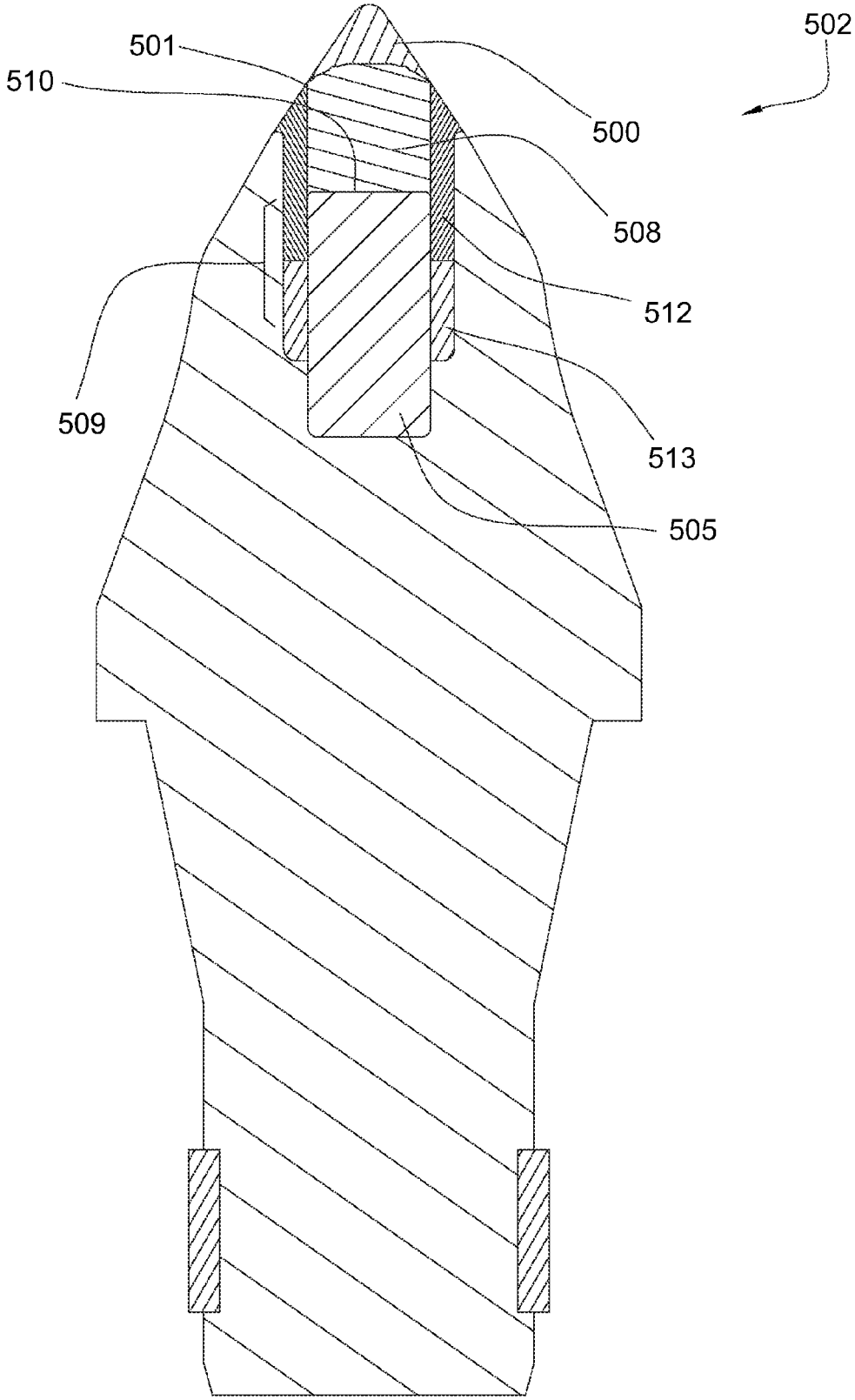
FIG. 5 discloses a cross-sectional view of an alternative embodiment of a pick assembly.

FIG. 5 discloses a cross-sectional view of an embodiment of a pick assembly 502 wherein a sleeve 509 comprises a plurality of segments. The sleeve 509 may comprise a first sleeve 512 and a second sleeve 513. The first sleeve 512 may extend from a bore entrance 501 and past an intersection 510 between substrate 508 and bolster 505. The second sleeve 513 may extend at least a portion of a length of the bolster 505. The first sleeve 512 may experience greater stress loads than those stress loads experienced by the second sleeve 513. To compensate for this, the first sleeve 512 may comprise a material that is stronger than material for the second sleeve 513.

Figure 6:
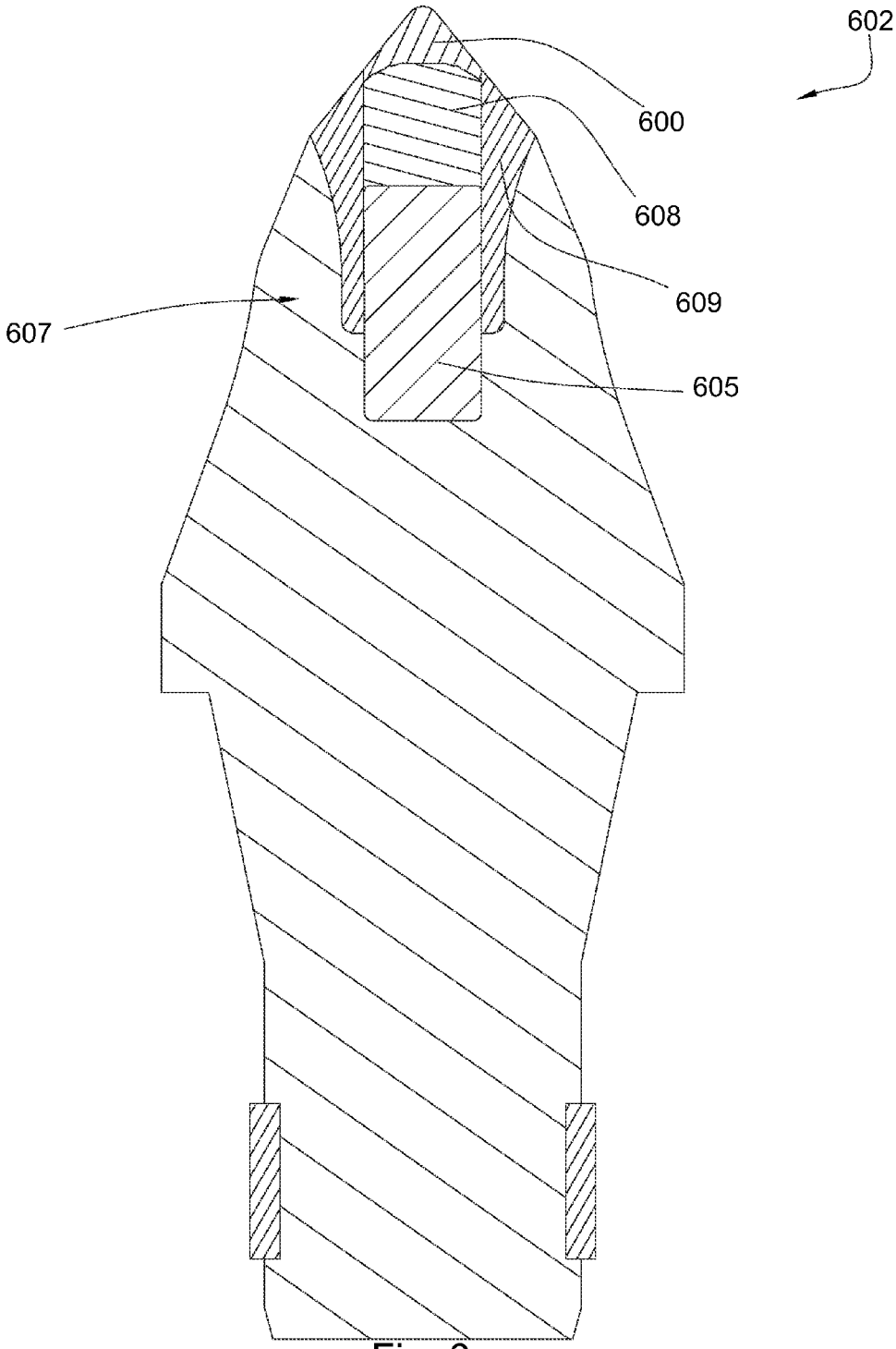
FIG. 6 discloses a cross-sectional view of an alternative embodiment of a pick assembly.

FIG. 6 discloses a cross-sectional view of an embodiment of a pick assembly 602. A sleeve 609 may comprise a geometry to provide improved support to the pick assembly 602 and specifically to support a cutting element 600 of the pick assembly 602. The geometry of the sleeve 609 may extend outwards away from a core assembly 607 at an angle that is substantially equal to an angle of the cutting element 600. The taper may comprise a substantially concave geometry. In some embodiments, the taper may comprise a substantially straight taper towards the bolster 605. In other embodiments, the taper may comprise a substantially convex geometry as the taper extends towards the bolster 605. The sleeve 609 may comprise a greater diameter closest to the cutting element 600 and decrease as the sleeve 609 approaches the bolster 605. The diameter may be greater at the cutting element 600 to provide strength necessary to withstand greater stress loads inflicted there during degradation operations. Costs of the pick assembly 602 may be reduced by decreasing the diameter of the sleeve 609. The sleeve 609 may comprise a more costly material because it needs to withstand greater stress loads that occur there during degradation operations to support the substrate 608 and bolster 605 that in turn work together to support the cutting element 600.

Figure 7:
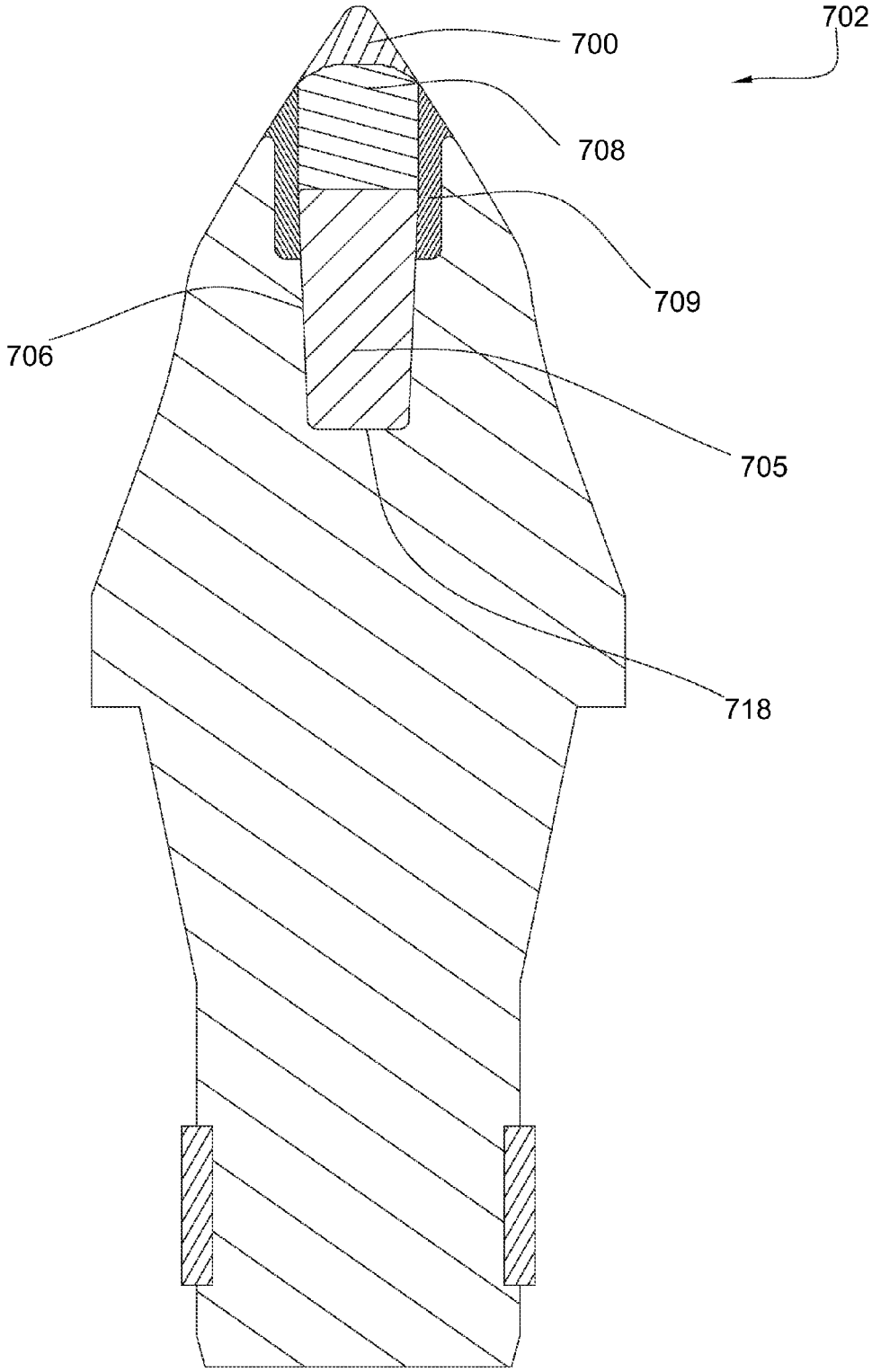
FIG. 7 discloses a cross-sectional view of an alternative embodiment of a pick assembly.

FIG. 7 discloses a cross-sectional view of an embodiment of a pick assembly 702. A bolster 705 may comprise a negative tapered slope wherein the diameter of the bolster 705 continues to narrow as it extends towards a distal end 718 of said bolster 705. The tapered slope may ensure a better press fit between the bolster 705 and an axial bore 706 of the pick assembly 702. The pick assembly 702 may also comprise a sleeve 709 wherein said sleeve may provide support to a substrate 708 and a bolster 705 to increase the overall working life span of the pick assembly 702.

Figure 8:
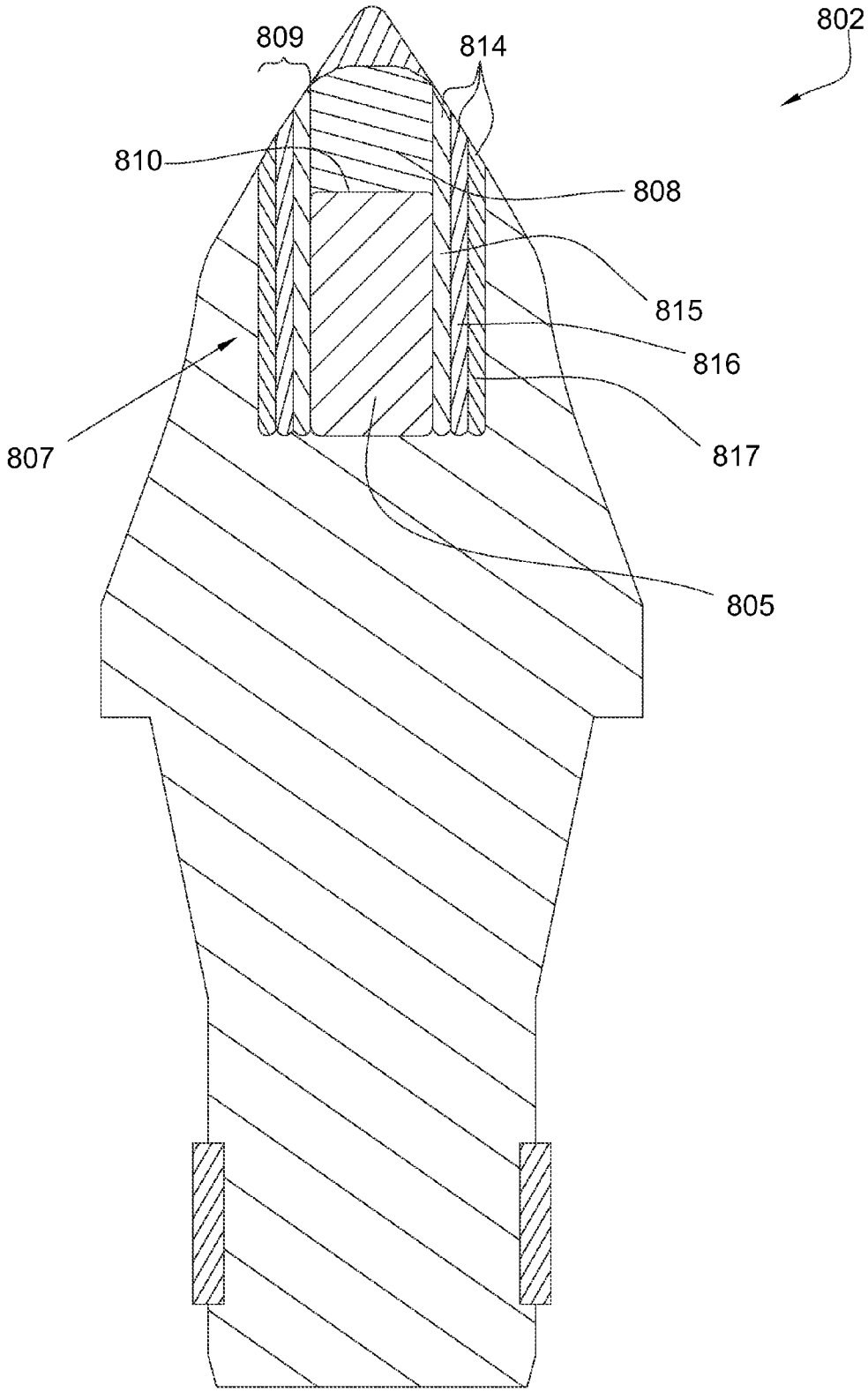
FIG. 8 discloses a cross-sectional view of an alternative embodiment of a pick assembly.

FIG. 8 discloses a cross-sectional view of an alternative embodiment of a pick assembly 802. A sleeve 809 may comprise multiple segments 814 with an inner most segment 815 that may be disposed around at least a portion of a substrate 808 and bolster 805. An innermost segment 815 may be shrink fitted around the substrate 808 and bolster 805. After the shrink fitting occurs, an additional segment 816 may be added to an outside surface of the inner most segment 815. The additional segment 816 may also be shrink fit around the inner most segment 815. Material used for the multiple segments 814 may differ from segment to segment. In some embodiments, the material used for the multiple segments 814 may be the same throughout all the segments. An outermost segment 817 may be disposed around the additional segment 816 and experience stress loads that are more damaging than the stress loads experienced by the innermost segment 815. In some embodiments the sleeve 809 may provide a means of reducing stress loads to a core assembly 807. In yet other embodiments the sleeve 809 may also serve to reduce a bending moment along the length of the core assembly 807. The stress loads may begin at and be greatest at the outermost segment 817 and decrease in magnitude towards the innermost segment 815. As a result, materials used for the multiple segments 809 may be strongest at the outermost segment 817 and decrease in strength towards the innermost segment 815. In yet other embodiments, the innermost segment 815 may comprise a material with higher strength properties and decrease outwards towards the outermost segment 817. The innermost segment 815 may comprise the higher strength material because it is closest to the substrate 808 and bolster 805. As a result, the innermost segment 815 may be vital in helping to maintain the integrity of the brazed bond that forms an intersection 810 between the substrate 808 and bolster 805.

Figure 9A:
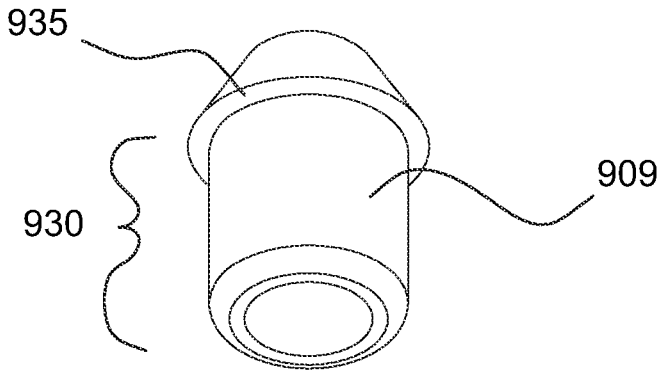
FIGS. 9*a* and 9*b* disclose orthogonal views of embodiments of sleeves without axial ribs and comprising axial ribs respectively.
Figure 9B:
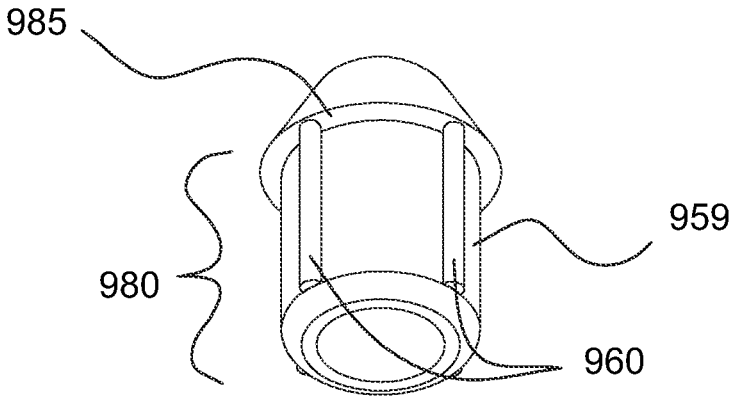

FIGS. 9*a* and 9*b* disclose orthogonal views of embodiments of sleeves without axial ribs and comprising axial ribs respectively. An embodiment of a sleeve 909 is shown comprising a generally tubular body 930 with an annular flange 935 disposed on one end. It is believed that the annular flange 935 may aid in protecting a pick body from wear. Another embodiment of a sleeve 959 is shown comprising a generally tubular body 980 with an annular flange 985 disposed on one end and further comprising a plurality of axial ribs 960 disposed about the generally tubular body 980. It is believed that the axial ribs 960 may aid in reducing bending of the tubular body 980 when under stress.

Figure 10:
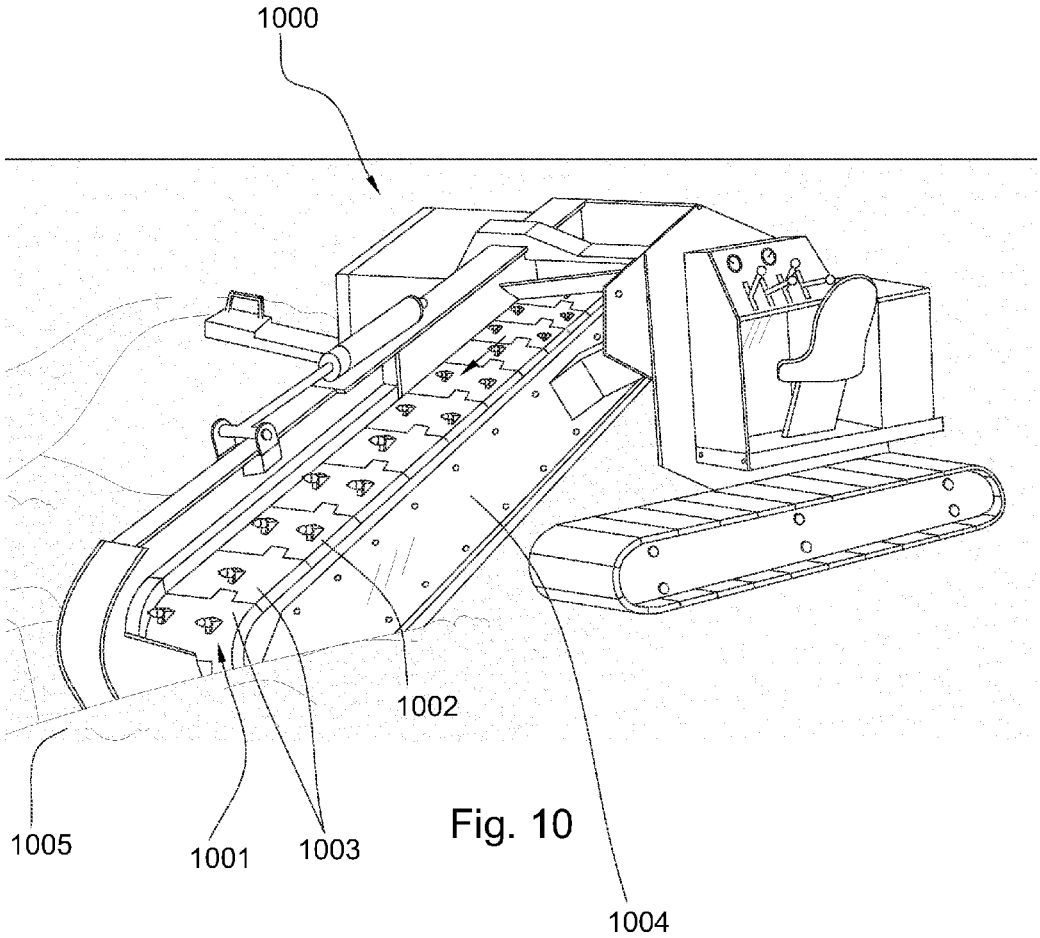
FIG. 10 discloses an orthogonal view of an embodiment of a trenching machine.

FIG. 10 discloses an orthogonal view of an embodiment of a trenching machine 1000 comprising a rotating surface 1001 further comprising at least one pick assembly 1002 of the present invention. The at least one pick assembly 1002 may be disposed on multiple interconnected plates 1003 disposed on an arm 1004 that allows the rotating surface 1001 to rotate downwards and into a formation 1005, degrading the formation 1005 into aggregate. In some embodiments the trenching machine 1000 may incorporate a core assembly wherein the core assembly assists to increase the overall working life span of the pick assembly 1002.

Figure 11:
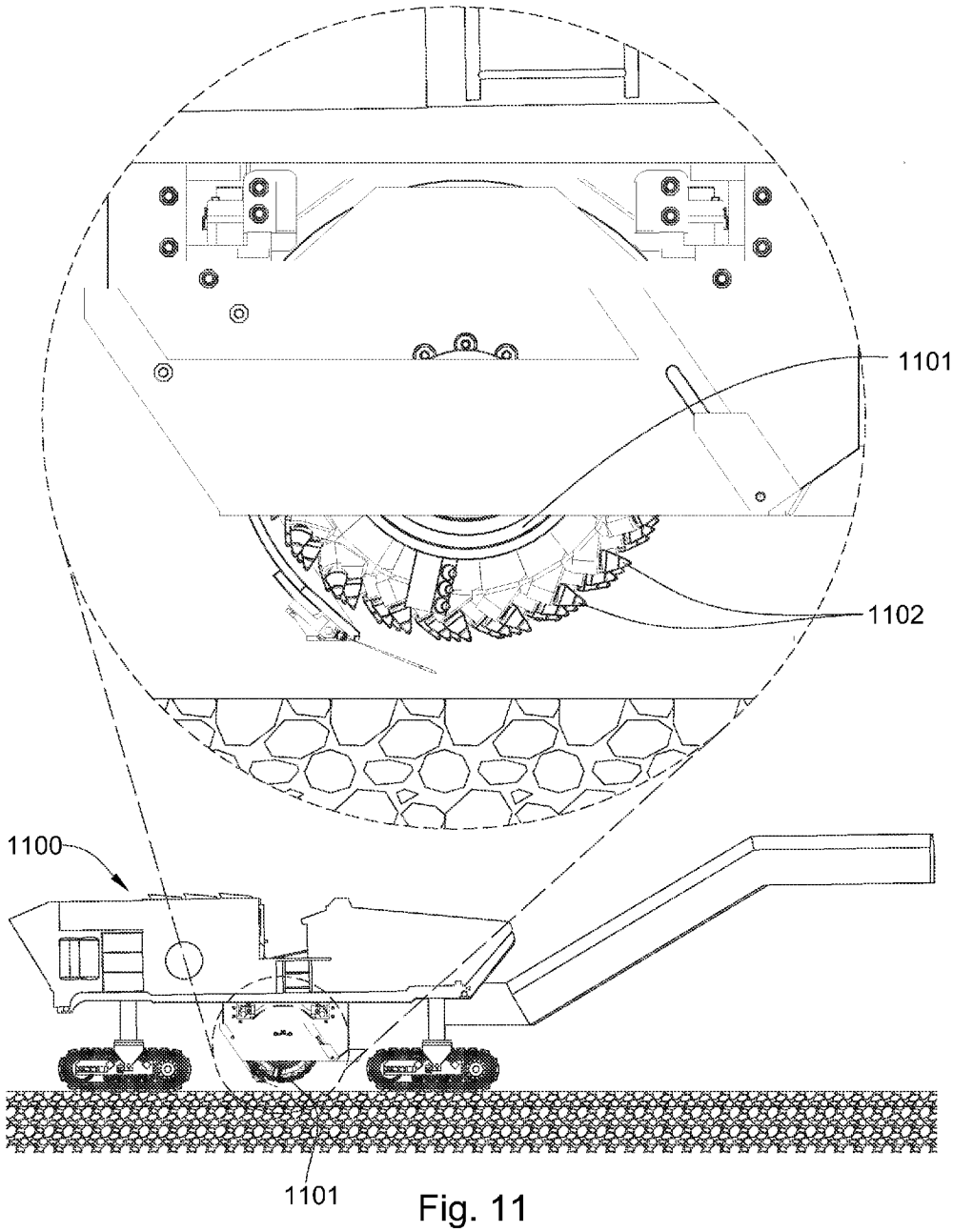
FIG. 11 discloses a side view of an embodiment of a milling machine.

FIG. 11 discloses a side view of an embodiment of a milling machine 1100 comprising a rotary degradation drum 1101 (shown in the magnified view) disposed on an underside of the milling machine 1100. A plurality of pick assemblies 1102 of the present invention are disposed on the rotary degradation drum 1101. Each pick assembly 1102 may comprise a core assembly wherein the core assembly assists to increase the overall working life span of the pick assembly 1102.

Whereas the present invention has been described in particular relation to the drawings attached hereto, it should be understood that other and further modifications apart from those shown or suggested herein, may be made within the scope and spirit of the present invention.

What is claimed is:

1. A pick assembly, comprising:

a pick body comprising a shank opposite a front end;

the shank configured for attachment to a driving mechanism;

the front end comprising a core assembly disposed within and protruding from an axial bore of the front end; and the core assembly comprising a cutting element bonded to a substrate and a bolster attached to the substrate opposite the cutting element;

wherein at least part of the substrate and at least part of the bolster are nonrotatively disposed within a sleeve.

2. The assembly of claim 1, wherein a portion of the bolster is configured to form a press fit with the axial bore of the front end.

3. The assembly of claim 1, wherein the substrate and bolster comprise substantially equal diameters.

4. The assembly of claim 1, wherein the sleeve comprises a plurality of segments.

5. The assembly of claim 1, wherein the sleeve is shrink fitted around at least a portion of the substrate and the bolster.

6. The assembly of claim 1, wherein the sleeve holds at least a portion of the substrate and the bolster under compression.

7. The assembly of claim 1, wherein the sleeve is configured to form a press fit within the axial bore of the front end.

8. The assembly of claim 1, wherein the sleeve comprises axial ribs disposed on an outer surface of the sleeve that are in contact with the axial bore.

9. The assembly of claim 1, wherein the sleeve comprises an annular flange overlapping a portion of the front end.

10. The assembly of claim 9, further comprising a fillet between the sleeve and the annular flange.

11. The assembly of claim 1, wherein the cutting element is bonded to the substrate by a high pressure high temperature process.

* * * * *